US007686599B2

(12) United States Patent
Vondenstein et al.

(10) Patent No.: US 7,686,599 B2
(45) Date of Patent: Mar. 30, 2010

(54) SCROLL COMPRESSOR WITH DEVICE TO LIMIT ORBIT RADIUS

(75) Inventors: John S. Vondenstein, Hot Springs, AR (US); Edward A. Tomayko, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 21 days.

(21) Appl. No.: 11/955,442

(22) Filed: Dec. 13, 2007

(65) Prior Publication Data

US 2009/0155110 A1 Jun. 18, 2009

(51) Int. Cl.
*F03C 2/00* (2006.01)
*F03C 4/00* (2006.01)

(52) U.S. Cl. ..... 418/55.3; 418/55.1; 418/109; 417/220; 417/212

(58) Field of Classification Search ..... 418/55.1–55.5, 418/57, 109, 181; 417/310, 220, 212
See application file for complete search history.

(56) References Cited

U.S. PATENT DOCUMENTS

| | | | | |
|---|---|---|---|---|
| 5,545,019 | A * | 8/1996 | Beck et al. | 418/55.1 |
| 5,611,674 | A | 3/1997 | Bass et al. | |
| 6,386,847 | B1 * | 5/2002 | Bush et al. | 418/55.5 |
| 6,742,996 | B2 * | 6/2004 | Ueda et al. | 417/310 |

FOREIGN PATENT DOCUMENTS

| | | |
|---|---|---|
| EP | 1217213 | 6/2006 |

OTHER PUBLICATIONS

Search Report dated Dec. 10, 2008.

* cited by examiner

*Primary Examiner*—Theresa Trieu
(74) *Attorney, Agent, or Firm*—Carlson, Gaskey & Olds

(57) ABSTRACT

A scroll compressor has a device which may be actuated to limit the orbit radius of the orbiting scroll. The device is moveable between an unactuated position at which it is spaced from a hub for the scroll compressor, and an actuated position at which it limits the orbit radius of the hub. The device may be actuated when reduced capacity is desired.

9 Claims, 3 Drawing Sheets

SCROLL COMPRESSOR WITH DEVICE TO LIMIT ORBIT RADIUS

BACKGROUND OF THE INVENTION

This application relates to a scroll compressor, wherein a device can limit the orbit radius of the orbiting scroll to limit the capacity of the scroll compressor.

Scroll compressors are becoming widely utilized in refrigerant compression applications. In a scroll compressor, a pair of scroll members each have a base and a generally spiral wrap extending from the base. The spiral wraps interfit and contact each other to define compression chambers. One of the two scroll members is caused to orbit relative to the other, and as the relative orbital movement occurs, the size of the compression chambers decreases, and an entrapped refrigerant is compressed.

It is sometimes desirable to limit the capacity of the scroll compressor, to reduce the load on an electric motor for driving the scroll compressor. Thus, various methods for reducing the capacity are known. In general, these methods can be somewhat complex, and cumbersome.

SUMMARY OF THE INVENTION

In the disclosed embodiment of this invention, an orbit limiting device is moveable between an actuated and an unactuated position, and serves to contact and limit movement of the orbiting scroll when at the actuated position. In a disclosed embodiment, a ring is driven over a pair of angled side pieces, to cam the side pieces radially inwardly to contact the orbiting scroll, and limit movement.

These and other features of the present invention can be best understood from the following specification and drawings, the following of which is a brief description.

DETAILED DESCRIPTION OF THE PREFERRED EMBODIMENT

Figure 1:
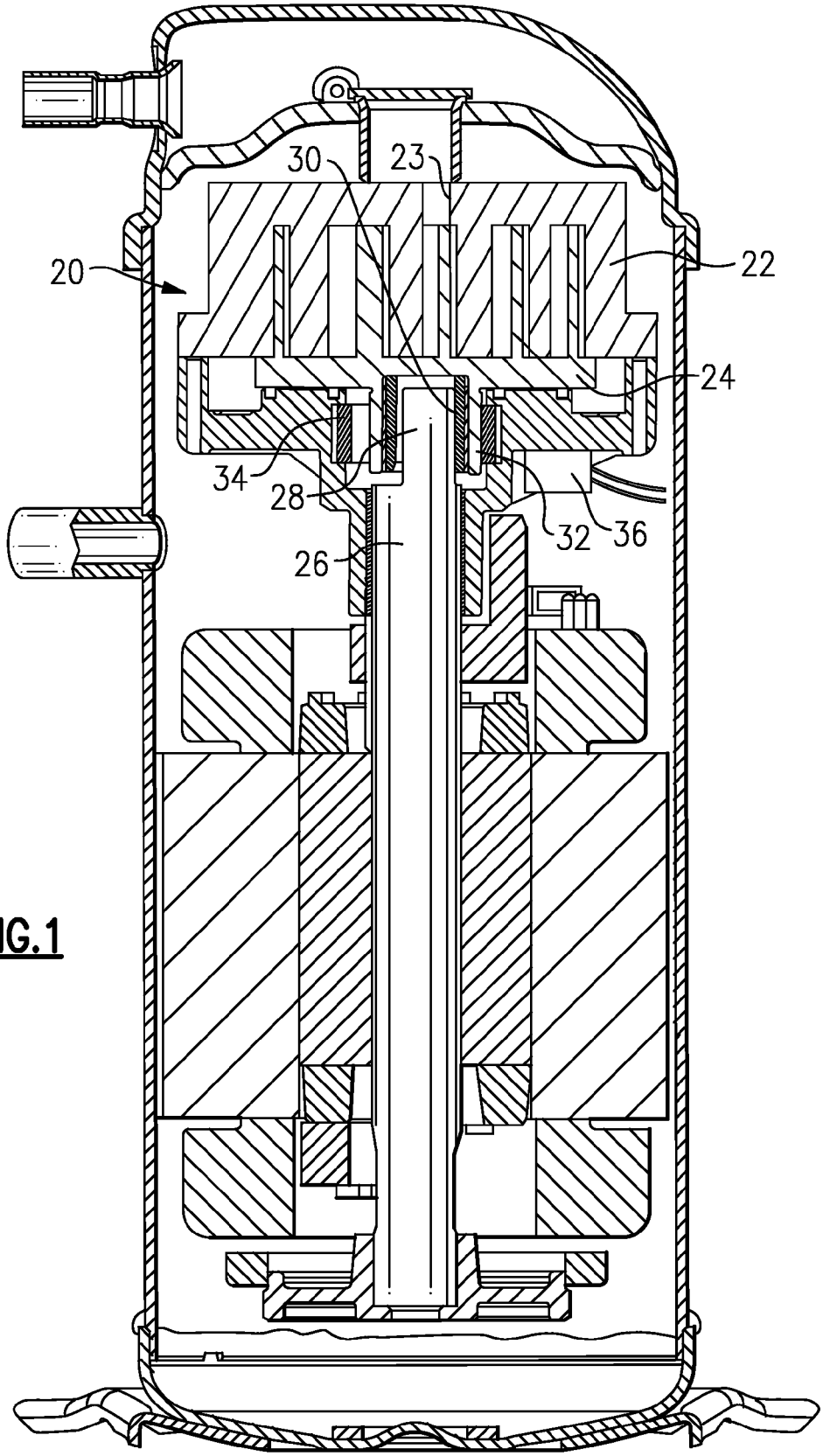
FIG. 1 shows a first embodiment of the present invention.

The scroll compressor 20 is illustrated in FIG. 1 having a non-orbiting scroll 22 and an orbiting scroll 24. As known, a shaft 26 has an eccentric pin 28 that fits into a slider block 30. The slider block 30 moves within a hub 32 of the orbiting scroll 24. The rotation of the driveshaft 26 thus causes the orbiting scroll 24 to orbit relative to the non-orbiting scroll 22. As this occurs, the size of compression chambers defined between the orbiting and non-orbiting scroll members is decreased and an entrapped refrigerant is compressed and driven toward a discharge port 23.

At times it would be desirable to reduce the capacity, or amount of refrigerant compressed to the discharge port 23. This may be desirable to reduce the load on a motor for driving the shaft 26, and thus save energy costs.

In one embodiment, an orbit limiting device 34 is incorporated outwardly of the hub 32. A control 36 may be a solenoid or other electronic actuator which serves to move the device 34 between actuated and non-actuated positions.

Figure 2:
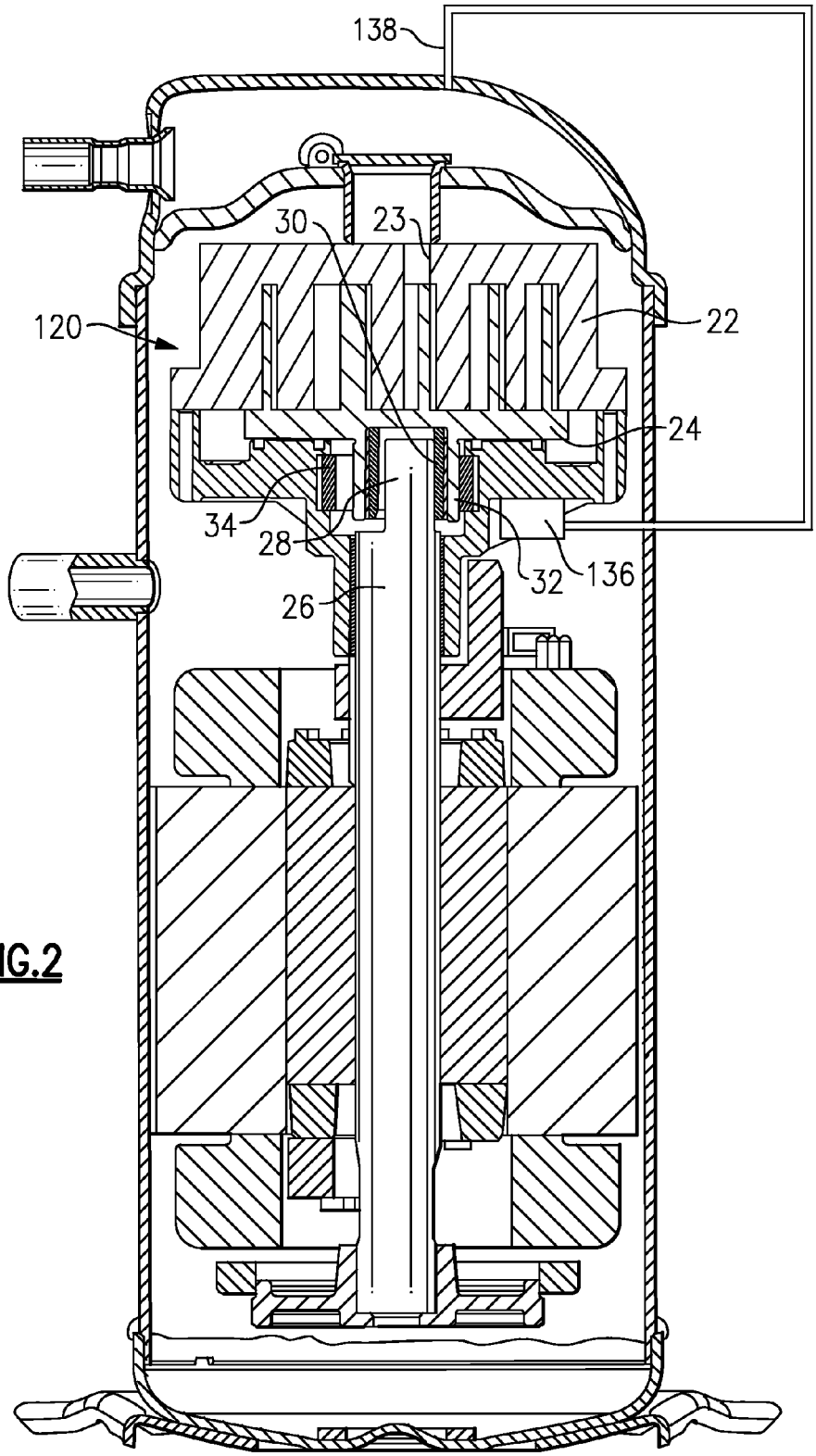
FIG. 2 shows a second embodiment.

FIG. 2 shows another embodiment 120, wherein the control 136 may be supplied with discharge refrigerant from a tap 138. That is, in this embodiment, the device 34 may be actuated by a fluid. Rather than refrigerant, a source of compressed air may also be utilized. The supply of fluid is shown schematically. In practice, one may supply it entirely within the housing.

Figure 3A:
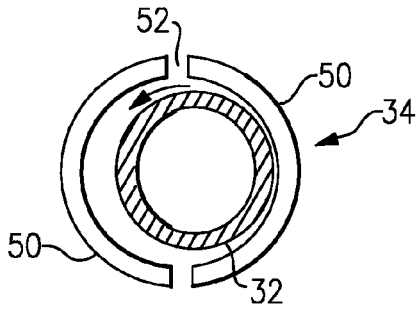
FIG. 3A shows an unactuated position.

FIG. 3A shows the operation of the device 34. As shown in FIG. 3A, the device is in its unactuated position. The hub 32 is allowed to orbit through its normal orbiting cycle. Spaced portions 50 of the device 34 are spaced away from an outer periphery of the hub 32. Gaps 52 are found between the portions 50.

Figure 3B:
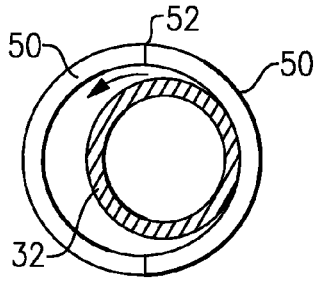
FIG. 3B shows the actuated position.

FIG. 3B shows the actuated position. The portions 50 have been driven together, and the gaps have been eliminated. The hub 32 will now be restricted to a much smaller orbit. With this smaller orbit, the wraps of the orbiting and non-orbiting scroll member may not be able to seal throughout the whole cycle, and there will be a reduced amount of refrigerant compressed. The force F from the actuators may be transmitted by any metal. A worker in this art could identify an appropriate transmission path.

Figure 4A:
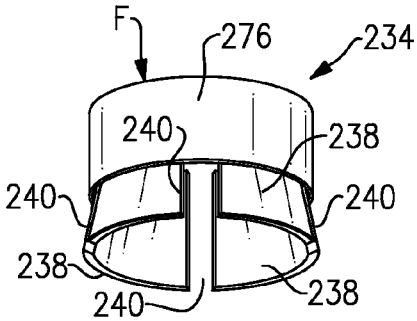
FIG. 4A shows one orbit limiting device.

FIG. 4A shows one embodiment 234 of the device which may be utilized for the device 34. As shown, an outer ring 276 surrounds two separate inner portions 238. Gaps 240 are formed between the portions 238.

Figure 4B:
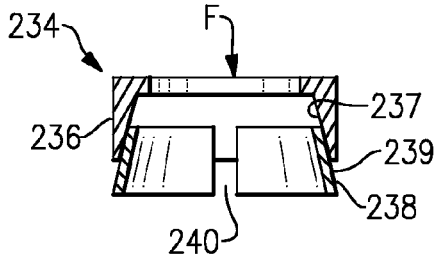
FIG. 4B is a cross-sectional view through the FIG. 4A device.

As shown in FIG. 4B the portions 238 have an angled outer surface 239. The actuator may be arranged to provide a force F downwardly on the ring 236 to cause an inner surface 237 to cam the angled outer surface 239 radially inwardly such that the elements 238 behave as the elements 50 in FIGS. 3A and 3B. As can be appreciated, the outer ring 236 will move in a direction that is generally parallel to a drive axis of the drive shaft 26, and will cam the portions 238 radially inwardly and toward each other. Thus, the movement of the outer ring is generally perpendicular to the movement of the portions toward each other.

Of course, other methods of limiting the orbiting movement of the hub may be utilized.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from its base, said wraps interfitting to define compression chambers;

said second scroll member having a hub extending away from its base in an opposed direction to said wrap, a shaft having an eccentric pin extending upwardly into said hub, and a slider block positioned between said eccentric pin and an inner periphery of said hub; and an orbit limiting device moveable between actuated and unactuated positions to contact said hub, and limit the orbit radius of said second scroll member when actuated, said orbit limiting device includes at least a plurality of separate parts, with said separate parts being spaced apart in said unactuated position, and being spaced closer together in said actuated position.

2. The scroll compressor as set forth in claim 1, wherein a first ring is forced downwardly by an actuator to force said separate parts closer together and to said actuated position.

3. The scroll compressor as set forth in claim 2, wherein said separate parts have an angled outer surface such that when said ring is forced downwardly on said separate parts they are forced radially inwardly and closer together.

4. The scroll compressor as set forth in claim 1, wherein said actuator is electric.

5. The scroll compressor as set forth in claim 1, wherein said actuator is fluid driven.

6. A scroll compressor comprising:

a first scroll member having a base and a generally spiral wrap extending from said base;

a second scroll member having a base and a generally spiral wrap extending from its base, said wraps interfitting to define compression chambers;

said second scroll member having a hub extending away from its base in an opposed direction to said wrap, a shaft having an eccentric pin extending upwardly into said hub, and a slider block positioned between said eccentric pin and an inner periphery of said hub; and an orbit limiting device moveable between actuated and unactuated positions to contact said hub, and limit the orbit radius of said second scroll member when actuated, said orbit limiting device including a first portion forced by an actuator to move a second portion to contact the hub and limit the orbit radius of the hub, the movement of the first portion being generally perpendicular to the movement of the second portion.

7. The scroll compressor as set forth in claim 6, wherein said first portion is a ring.

8. The scroll compressor as set forth in claim 6, wherein said second portion includes at least two separate portions.

9. A scroll compressor comprising:

a first scroll member having a base and a generally spiral wrap extending from said base;

a second scroll member having a base and a generally spiral wrap extending from its base, said wraps interfitting to define compression chambers;

said second scroll member having a hub extending away from its base in an opposed direction to said wrap, a shaft having an eccentric pin extending upwardly into said hub, and a slider block positioned between said eccentric pin and an inner periphery of said hub; and an orbit limiting device moveable between actuated and unactuated positions to contact said hub, and limit the orbit radius of said second scroll member when actuated, said orbit limiting device including a ring forced by an actuator to force a separate portion to contact the hub and limit the orbit radius of the hub.

* * * * *